United States Patent [19]

Hallam

[11] 4,226,056

[45] Oct. 7, 1980

[54] FASCIA GUTTER

[75] Inventor: Dennis M. Hallam, Zillmere, Australia

[73] Assignee: E. Sachs & Co. Ltd., Zillmere, Australia

[21] Appl. No.: 4,526

[22] Filed: Jan. 18, 1979

[30] Foreign Application Priority Data

Jan. 19, 1978 [AU] Australia ..... 3080/78

[51] Int. Cl.[2] ..... E04D 13/04

[52] U.S. Cl. ..... 52/11; 52/94; 248/48.1

[58] Field of Search ..... 52/11, 12, 15, 16, 94, 52/95; 248/48.1, 48.2

[56] References Cited

U.S. PATENT DOCUMENTS

| | | | |
|---|---|---|---|
| 317,841 | 5/1885 | Newton | 52/11 |
| 3,080,682 | 3/1963 | Teutsch | 52/12 |
| 3,913,284 | 10/1975 | Hall | 52/11 |
| 4,128,974 | 12/1978 | Taylor | 52/11 |

FOREIGN PATENT DOCUMENTS

| | | | |
|---|---|---|---|
| 272934 | 2/1967 | Australia | 52/11 |
| 296054 | 4/1967 | Australia | 248/48.2 |
| 485268 | 5/1975 | Australia | 248/48.2 |
| 1370694 | 7/1964 | France | 52/11 |
| 2275608 | 1/1976 | France | 52/94 |

*Primary Examiner*—Alfred C. Perham

*Attorney, Agent, or Firm*—Schwartz, Jeffery, Schwaab, Mack, Blumenthal & Koch

[57] ABSTRACT

A fascia gutter assembly comprises a gutter of channelled form, with a bottom and upright front and rear flanges, supported by a series of brackets adapted to be secured to the roof structure of a building, the brackets also supporting a fascia panel below and substantially co-planar with the front flange of the gutter, the top of the fascia panel being clipped into engagement with the bottom of the gutter, the gutter front flange and fascia panel then having the appearance of a single fascia.

8 Claims, 3 Drawing Figures

FIG. 2.
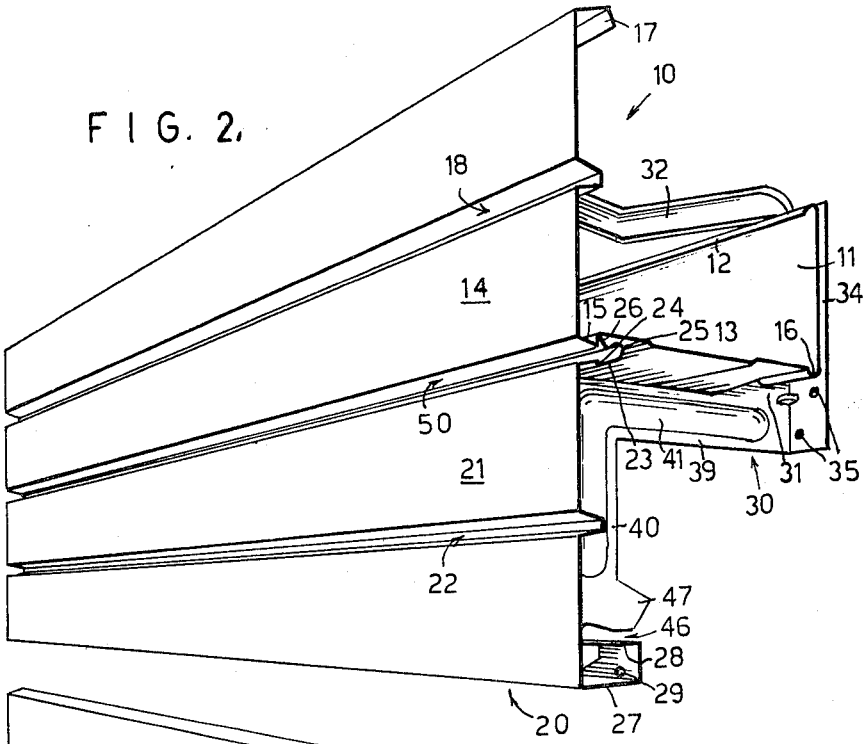
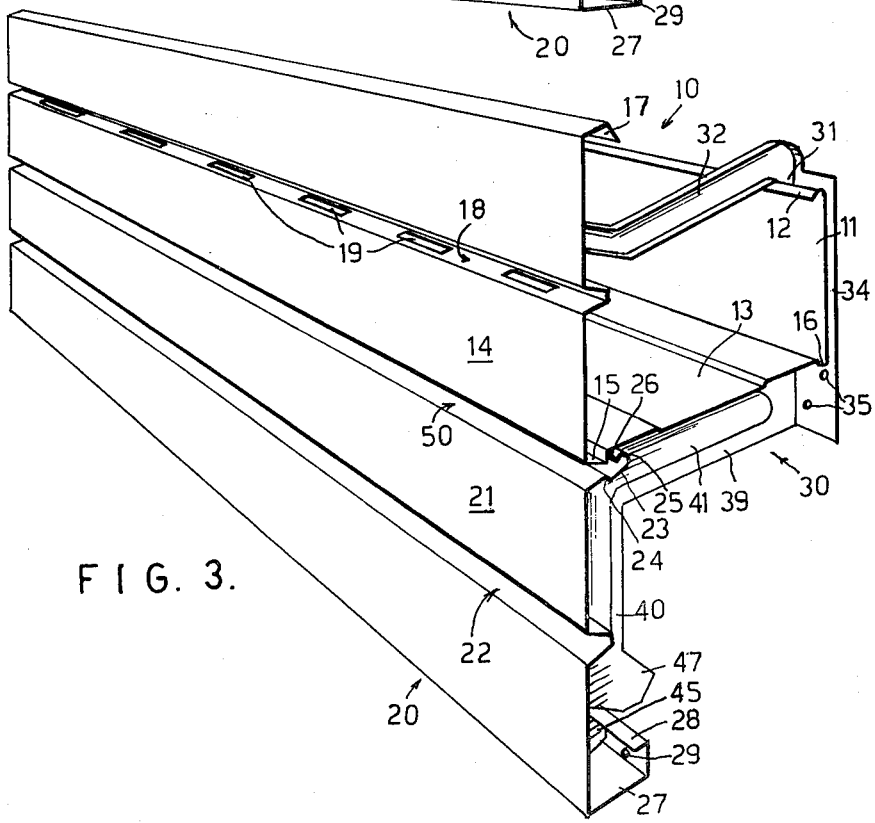
FIG. 3.

FASCIA GUTTER

BACKGROUND OF THE INVENTION

This invention relates to an improved fascia gutter.

A type of gutter commonly installed on a house or other building to receive water from the roof and conduct to to downpipes is of channelled form, and is attached to a fascia board by gutter brackets, the roof tiles or other roofing members projecting over the top of the fascia board and the rear flange of the gutter. To prevent driven rain from entering under the tiles or roofing sheets, and also to conceal the edges of these from view, the front flange of the gutter is higher than the rear flange.

Such a gutter is not aesthetically pleasing, being an obvious and obstrusive addition to the fascia board, projecting forwardly from its upper part, and with downpipes extending down in front of the fascia board and angled back to the wall of the building. Moreover, the installation of fascia board and guttering is time consuming and expensive.

BRIEF SUMMARY OF THE INVENTION

The present invention has been devised with the general object of providing a fascia gutter assembly which is aesthetically and architecturally attractive, and simple and economical to manufacture and to install.

With the foregoing and other objects in view, the invention resides broadly in a fascia gutter assembly including a channelled gutter with a bottom and front and rear flanges; a fascia panel, means for mounting the gutter and fascia panel on a roof structure in such manner that the fascia panel is below the substantially coplanar with the front flange of the gutter; and catch means for releasably engaging the top part of the fascia panel with the bottom part of the gutter. The mounting means consists preferably of a series of mounting brackets, each having means for attachment to a building roof structure, normally to the ends of the rafters, and each having means whereby it may be releasably clipped into engagement with both the gutter and the fascia panel. The bottom of the gutter preferably engages with the top of the fascia in such manner as to form a longitudinal groove or recess at the junction, and each of the gutter front flange and the fascia panel is also formed with a similar longitudinal groove or recess, the three being equidistantly spaced and parallel. Overflow ports for the gutter, to prevent overfilling, are formed in the bottom face of the groove in the gutter's front flange, below the level of the rear flange, and the ports so located are not visible from normal line of vision. Other features of the invention will become apparent from the following description.

BRIEF DESCRIPTION OF THE DRAWINGS

A preferred embodiment of the invention is shown in the accompanying drawings, wherein:

FIG. 2 is a perspective view of the fascia gutter assembly viewed from a low level, and FIG. 3 is a perspective view of the fascia gutter assembly viewed from above.

Figure 1:
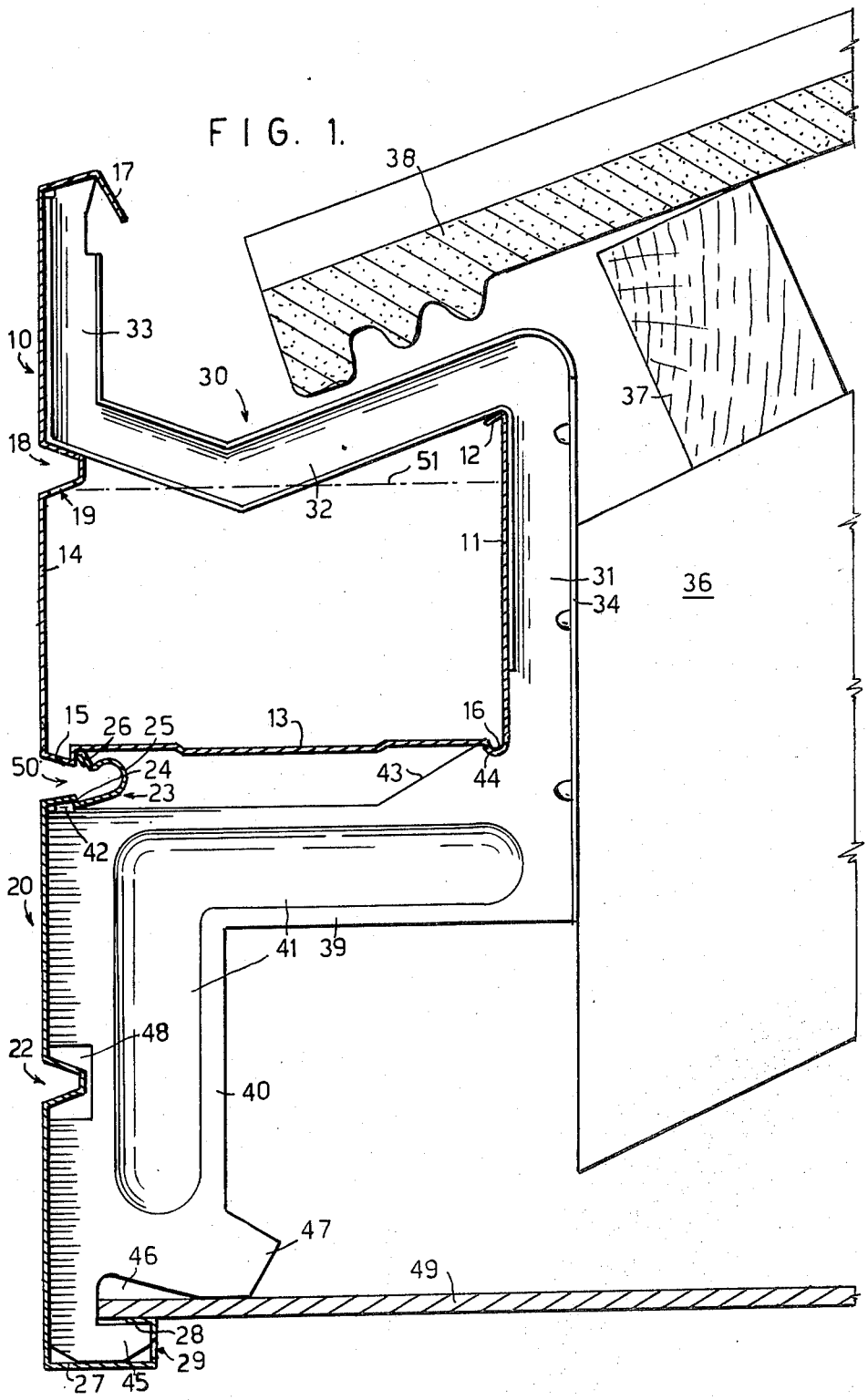
FIG. 1 is a cross-sectional view of a fascia gutter assembly according to the invention, and part of a roof structure to which it is applied.

The assembly illustrated includes a gutter 10 of sheet metal, shaped to form a channel having a rear flange 11 with a top return flange 12, a bottom section 13 and a front flange 14 of considerably greater height than the rear flange.

The bottom section 13 is shaped to form an angular bottom front bead 15 adjacent to the front flange 14, and an arcuately curved bottom rear bead 16 adjacent to the rear flange 11.

The front flange 14 has its upper part bent along parallel lines through two acute angles to form a hooked support flange 17. About midway between its top and bottom, the front flange 14 is formed with a fairly deep continuous longitudinal groove or concavity 18, of which the top and bottom faces are rearwardly convergent. In the bottom face or upwardly-facing surface of this groove 18 there are formed overflow ports 19, being a longitudinal series of equally spaced fairly large slotted holes, which are some distance below the level of the top of the rear flange 11 of the gutter.

The assembly also includes a fascia panel 20 of sheet metal having a front face 21 of approximately the same depth as the front flange 14 of the gutter, and with a continuous longitudinal groove or concavity 22 midway between its top and bottom, and of similar profile to the groove 18 of the gutter.

The top of the fascia panel is shaped to form a locking strip 23. From the top of the front face 21, this strip inclines upwardly towards the rear, has a downwardly stepped formation at 24, then continues its upward and rearward inclination for some distance before curving upwardly and forwardly at 25, terminating in an upwardly and forwardly inclined flashing strip 26.

The bottom of the fascia channel is shaped to form a rearwardly extending bottom channel 27, the rear flange of which is bent forward at the top to constitute a soffit support flange 28. At intervals, small drainage holes 29 are formed in the rear flange of the bottom channel 27.

Both the gutter 10 and the fascia panel 20 are fixed on a series of mounting brackets 30 or pressed sheet metal. Each bracket has an upright back piece 31 from the top of which an upper arm 32 extends forwardly, inclining downwardly for some distance and then inclining upwardly towards its front, from which there extends an integral top front upright 33. To impart rigidity, the upper arm 32 and most of the top front upright 33 and of the back piece 31 are pressed to channel form, the rear flange of the channelled back piece 31 being extended to constitute an attachment plate 34 with nail holes 35 (some of which are shown in FIGS. 2 and 3) to enable the bracket 30 to be nailed directly to the vertical end of a rafter 36 of a roof structure, which does not include the fascia board customarily provided. Battens 37 nailed onto the rafters 36 support roofing tiles 38.

From the bottom of the back piece 31 of each bracket 30 a lower arm 39 extends forwardly, a bottom front upright 40 extending downwardly from its front end, an angled reinforcing rib 41 being pressed from the lower arm and bottom front upright to impart rigidity.

The top of the lower arm 39 has, at the front, an upwardly extending retaining lug 42, and towards the back, an upwardly inclining ramp 43 leading to a downwardly extending notch 44 next to the back piece 31 of the bracket.

The bottom front upright 40 has a rearwardly extending bottom lug 45, above which is a notch or recess 46, and above this recess is a rearwardly projection 47. A notch 48 is formed from the middle of the front of the bottom front upright 40.

The fascia panel is fitted by engaging its bottom channel 27 and flange 28 with the bottom lugs 45 of the brackets, and pressing the fascia panel back so the step 24 of locking strip 23 snaps into engagement with the bracket retaining lugs 42. Next the gutter is installed, hooking its support flange 17 on the front uprights 33 and pressing it back so its bottom rear bead 16 rides up the ramps 43 of the brackets and into the notches 44, the fascia panel flashing strip 26 then bearing against the gutter's bottom front bead 15 to exclude moisture from the junction of gutter and fascia panel. The gutter cannot lift as its return flange 12 and recessed part 18 are then located close under the upper arms 32 of the brackets.

A soffit 49 of sheet material is supported at its front on the soffit support flange 28 of the fascia panel, and is held down by the projections 47 of the brackets 30.

The gutter's bottom front bead 15 and the fascia panel's locking strip 23 define a continuous longitudinal recess 50 which, when the gutter is viewed from below, is of similar appearance to, and midway between, the longitudinal grooves or recesses 18 and 22 of the gutter and fascia panel. The co-planar gutter front flange 14 and fascia panel front face 21 therefore constitute a fairly deep unitary fascia with three equally spaced and similar horizontal grooves 18, 50 and 22, the overflow ports 19 in the upwardly-facing bottom surface of the top groove 18 not being visible from normal viewpoint. However, if the gutter 10 should become filled to the level indicated at 51 in FIG. 1, water will escape through the overflow ports and will not overflow the back flange 11 of the gutter, the top of which is at a considerably higher level. The junction of the gutter and the fascia panel is such that there will be very little likelihood of driven rain entering, but any moisture which may enter, or form by condensation, behind the fascia panel will be received in the bottom channel 27 and escape through the drainage holes 29.

The assembly may be installed quickly and easily and without any high degree of skill being required. The elimination of the customary fascia board will result in considerable economies in the construction of the building.

Moreover, as will be apparent from the drawings, and particularly FIG. 1, the gutter may be provided in usual manner with downpipes, not shown in the drawings, which, leading down and rearwardly from the gutter to the wall of the building, are concealed behind the fascia panel 20 and above the soffit 49, and therefore will be very unobstrusive and not detract from the appearance of the building.

I claim:

1. A fascia gutter assembly comprising (a) a series of mounting brackets adapted to be secured to a roof assembly, each bracket including an upper arm which extends forwardly, and upwardly at the front thereof;

(b) a gutter having substantially vertical front and back flanges, and a bottom wall interconnecting said flanges, said back flange being mounted on and supported by said brackets, said front gutter flange being formed with a rearwardly extending top support flange which extends over the upper end of the upper arm of said bracket, said upper arm including a vertically extending portion which bears on the upper part of said front flange below said top support flange, said gutter being further formed with a longitudinal channel having top and bottom faces, said bottom face being below the top of the back flange of said gutter and having overflow ports formed therein, and (c) a fascia panel mounted on and supported by said brackets below said gutter, the front wall of said fascia panel being coplanar with said front flange of said gutter.

2. The fascia gutter assembly of claim 1 further including means for releasably engaging the top part of said fascia panel with the bottom of said gutter.

3. The fascia gutter assembly of claim 1 wherein said means for releasably engaging said fascia panel and said gutter comprises a downwardly extending bottom front bead formed at the bottom of said front flange of said gutter, and a locking strip formed at the top of said fascia panel, said locking strip resiliently engaging behind said bead to exclude moisture from the joint.

4. The fascia gutter assembly of claim 3 wherein said bead is vertically spaced from the top of the front wall of said fascia panel thereby to form a groove parallel to said longitudinal channel formed in said gutter.

5. The fascia gutter assembly of claims 1 or 4 wherein said fascia panel is formed with a longitudinal groove in the front wall thereof, said groove being parallel to said longitudinal channel formed in said gutter.

6. The fascia gutter assembly of claim 1 wherein each of said mounting brackets further includes an intermediate arm extending horizontally, and a lower vertical arm against the front surface of which the front wall of said fascia panel engages, said lower vertical arm being formed with a rearwardly directed flange at the lower end thereof around which a bottom flange of said fascia panel extends.

7. The fascia gutter assembly of claim 6 wherein said bottom flange of said fascia panel is formed with drainage holes.

8. The fascia gutter assembly of claim 6 wherein said bottom flange of said fascia panel is turned upwardly and then forwardly to form a soffit support for supporting the front edge portion of a soffit.

* * * * *